US005422535A

United States Patent [19]

Verspaget et al.

[11] Patent Number: 5,422,535

[45] Date of Patent: Jun. 6, 1995

[54] CAPPED ELECTRIC LAMP

[75] Inventors: Godefridus N. M. Verspaget; Hendrikus A. M. Van Dulmen, both of Eindhoven, Netherlands

[73] Assignee: U.S. Philips Corporation, New York, N.Y.

[21] Appl. No.: 134,236

[22] Filed: Oct. 12, 1993

[30] Foreign Application Priority Data

Oct. 12, 1992 [EP] European Pat. Off. ..... 92203131

[51] Int. Cl.[6] ..... H01J 5/48

[52] U.S. Cl. ..... 313/318.08

[58] Field of Search ..... 313/623, 318, 613, 622, 313/624, 625

[56] References Cited

U.S. PATENT DOCUMENTS 3,906,275 9/1975 Spiessens ..... 313/318
4,542,316 9/1985 Hall et al. ..... 313/318

FOREIGN PATENT DOCUMENTS 0455295 11/1991 European Pat. Off. ..... H01J 61/36
000469408A 2/1992 European Pat. Off. ..... 313/623
2100404 12/1982 United Kingdom ..... H01J 61/00

*Primary Examiner*—Edward L. Coles, Sr.
*Assistant Examiner*—Jerome Grant, II
*Attorney, Agent, or Firm*—Paul R. Miller

[57] ABSTRACT

The capped electric lamp of the invention has a ceramic cap (10) having a shell portion (12) and an integral base portion (11) through which metal pins (13) pass. A lamp vessel (1) having a seal (4), from which current conductors (3) to an electric element (2) within the lamp vessel extend beside one another to the exterior, is fixed in the cap (10). Outside the lamp vessel the current conductors (3) each have a portion sealed in a glass envelope (6) which is connected to the seal. The glass envelopes (6) define a slit (5) between them. A ceramic partition wall (20) having a foot (21) is fixed on the base portion (11) and extends into the slit (5), thereby creating for the current conductors and respective contact members connected thereto their own compartment (14) in the cap. The lamp cap (10) and the partition wall (20) are readily obtainable and easy to assemble and nevertheless allow for high voltages to be used to ignite or to hot restrike the lamp.

12 Claims, 1 Drawing Sheet

CAPPED ELECTRIC LAMP

Figure 1A:
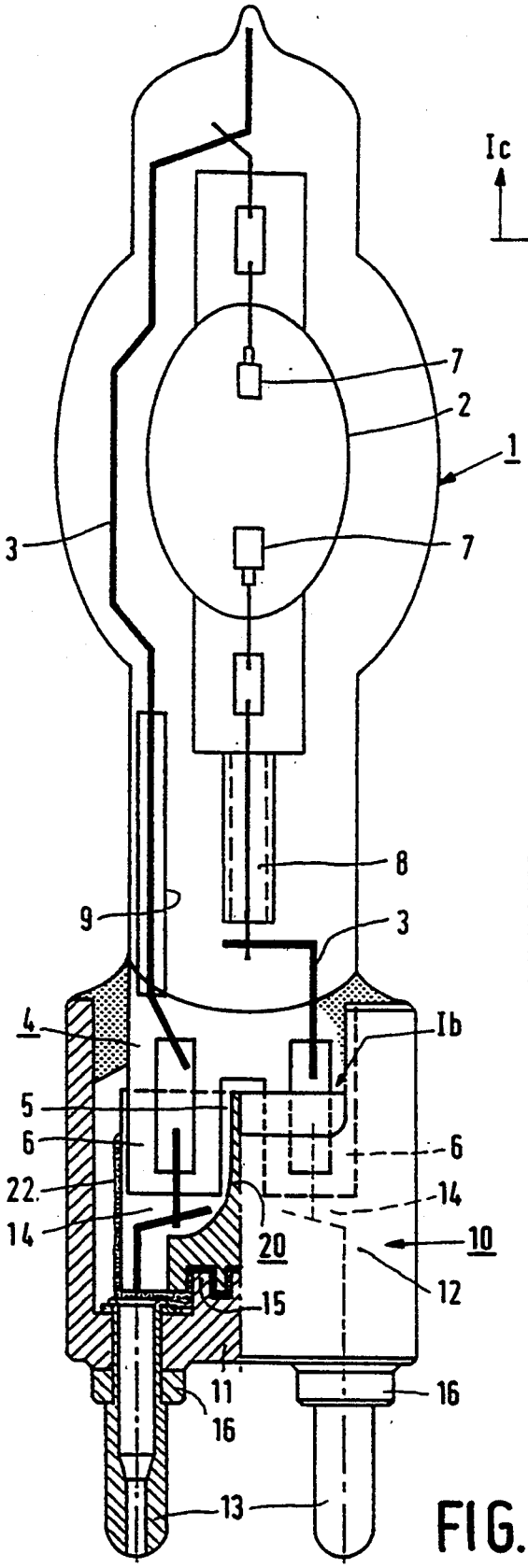

The invention relates to a capped electric lamp comprising:

a glass lamp vessel which is sealed in a vacuumtight manner and in which an electric element is arranged, which element is connected to current conductors which issue next to one another through a seal of the lamp vessel to the exterior where they each have a portion comprising an individual glass envelope which is connected to the seal, these envelopes being mutually separated by a slit;

a ceramic lamp cap having a base portion and a shell portion in which the seal of the lamp vessel is fixed, which lamp cap comprises electric contacts to each of which a respective current conductor is connected, and metal pins which project from the base portion to the exterior, a partition wall of insulating material being present in the lamp cap, extending into the slit of the lamp vessel and forming an individual compartment in the lamp cap for each of the current conductors in conjunction with the respective electric contact.

BACKGROUND OF THE INVENTION

Such a capped electric lamp is known from U.S. Pat. No. 4,542,316.

In the known lamp, the seal of the lamp vessel has a saw cut between the current conductors in order to give each current conductor its own glass envelope which is connected to the seal and which is separated from the other one by a slit. The object of this is to increase the electric creepage path between exposed portions of the current conductors. This enhances the possibility of the lamp being ignited at a comparatively high voltage of, for example, several kV. A further increase in the creepage path is achieved in that a partition wall in the lamp cap divides the lamp cap into compartments and enters the slit.

The known lamp cap is of the G38 type, a type having comparatively heavy metal pins whose centrelines are 38 mm removed from one another. Lamp caps of this or a similar type can be used in standardized lampholders. As a result, the known lamp can be used as a replacement for traditional halogen lamps, which do not require a high ignition voltage, in an environment comprising a standardized lampholder.

The known lamp cap is built up from two identical ceramic parts which are joined together when the lamp vessel is provided, together with contacts, metal pins, and mica plates which are to form the partition wall, and are fastened to one another with cement. For several applications, moreover, the electric element must be given a defined position relative to the lamp cap. This renders the assembly of the known electric lamp complicated.

European Patent Application EP 0 455 295 A1 discloses a high-pressure discharge lamp in which two saw cuts are made in the seal of the lamp vessel at a distance from one another and in which the glass between these saw cuts is broken away so as to make a slit. A fold is present in the base portion of the ceramic lamp cap of the lamp, extending to inside the slit.

A similar lamp is known from British Patent GB 2 100 404 B. Here a glass tube surrounding each of the current conductors is connected to the seal so as to form a slit between said current conductors. An incision is present running from the base portion of the ceramic lamp cap of the lamp which partly coincides with the slit. This lamp and the lamp of the cited EP 0 455 295 A1 have contact pins which are comparatively close together. They are designed for use in a lampholder which has a partition wall which enters the incision or the fold, respectively. Lampholders for lamp caps of the G38 type do not have such a partition wall.

SUMMARY OF THE INVENTION

It is an object of the invention to provide a capped electric lamp of the kind described in the opening paragraph which has a lamp cap of simple construction which is easy to assemble together with the lamp vessel.

According to the invention, this object is achieved in that the base portion and the shell portion form one integral body, and in that the partition wall is made of ceramic material and is provided with a foot which is fixed on the base portion.

The shell portion and the base portion of the lamp cap are integral, and yet the lamp cap in cooperation with the lamp vessel can withstand very high voltages. The lamp cap may be identical to a lamp cap which is suitable for use with a conventional halogen lamp. This leads to savings in the cost price of the lamp cap and thus of the lamp, and also to simpler logistics.

The partition wall may be provided immediately before or during mounting of the lamp vessel in the lamp cap. When the lamp vessel is fixed in the lamp cap, for example with cement, the partition wall is fixed at the same time and secured to the base portion.

Alternatively, the partition wall may be fixed on the base portion by means of metal pins. These may project each through an opening in the base portion and be fixed by means of, for example, a ranged or an upset rim. They may in that case grip around the foot of the partition wall, for example, in that they project through a recess or a hole in this foot. The lamp cap may then be fed to the assembly line of the lamp as an inseparable unit.

An alternative possibility is for the partition wall to be fixed in the lamp cap by means of an adhesive, for example a cement such as, for example, lamp cement. This may take place during or before mounting of the lamp vessel. In the latter case, the lamp cap is again made available on the assembly line of the lamp as a unit.

It is favourable for easy lamp cap manufacture when the base portion of the lamp cap is on average comparatively thin-walled, and thus contains comparatively little material. In a favourable embodiment, the base portion has corrugations between the metal pins transverse to the imaginary connecting line thereof, while the foot of the partition wall has corrugations which are complementary to the former. The corrugations facilitate positioning of the partition wall and keep the partition wall in position once it has been provided, or temporarily positioned when an adhesive is used, previous to curing or solidifying thereof. They also increase the creepage path along the base portion.

In a favourable embodiment, walls extend from the foot transverse to the partition wall, between which walls the seal of the lamp vessel is accommodated. A further increased resistance to high voltages can be achieved by this. The walls may be connected to the shell portion, if so desired, for example with cement, so as to seal any interstices.

For easy mounting, the partition wall extends to above the lamp cap in a favourable embodiment.

One or both pins of the lamp cap may serve as electric contact(s) of the lamp. Alternatively, separate elements may act as such. If the pins of the lamp cap form the contacts, it is favourable when they issue from the lamp cap to the exterior through ceramic rings provided outside the lamp cap. The electric creepage path along the outside of the base portion, given a certain interspacing of the pins, is then greater than if these rings were absent, while the manufacture of the lamp cap is simpler than if the rings were integral with the lamp cap. Ceramic rings have the additional advantage over metal rings that they lead to a greater metal/metal distance, i.e. from pin to pin, than do metal tings, i.e. from one, wider metal ting to the other. Ceramic tings here have a similar mechanical usefulness, i.e. distributing the mechanical forces exerted on the lamp cap by the pins, as well as a similar dimensional accuracy.

The electric element of the lamp may be a pair of electrodes in an ionizable filling. The lamp vessel then is a discharge vessel. Alternatively, however, the electric element may comprise an inner envelope. In an alternative embodiment of the lamp, the electric element may be a coil, for example a toroidal coil, surrounding an electrodeless discharge vessel filled with an ionizable gas.

The capped electric lamp may be used, for example, as a studio or theatre lamp, for projection purposes, or for creating light spots.

BRIEF DESCRIPTION OF THE DRAWING FIGURES

Figure 1B:
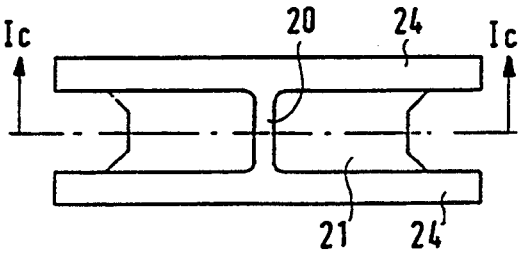
Figure 1C:
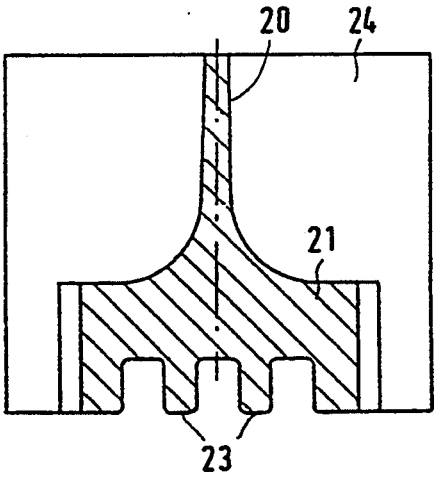

An embodiment of the capped electric lamp according to the invention is shown in the drawing in which FIG. 1*a* shows a capped electric lamp in side elevation with the lamp cap partly in cross-section;

FIG. 1*b* shows the partition wall in the lamp cap taken on the line Ib in FIG. 1*a*; and FIG. 1*c* is a cross-section through FIG. 1*b* taken on the line Ic.

DESCRIPTION OF THE INVENTION

In the drawing, the capped electric lamp has a lamp vessel 1 which is closed in a vacuumtight manner and in which an electric element 2 is arranged which is connected to current conductors 3 which issue next to one another to the exterior through a seal 4 of the lamp vessel. The current conductors each have a portion outside the lamp vessel which has its own glass envelope 6 connected to the seal, which envelopes arc separated from one another by a slit 5. The electric element 2 in the embodiment drawn is a discharge vessel, for example made of glass with an $SiO_2$ content of at least 95% by weight, such as quartz glass, in which electrodes 7, for example made of tungsten, are arranged in an ionizable medium. The medium may comprise, for, example, rare-earth bromide, mercury, mercury bromide, cesium iodide, and rare gas, for example, argon/krypton with a pressure of, for example 80, mbar. Inside the lamp vessel, the current conductors are screened from one another by glass tubes 8 and 9 where they run adjacent one another. The lamp is provided with a ceramic lamp-cap 10 of, for example, steatite with a base portion 11 and a shell portion 12 in which the seal 4 of the lamp vessel 1 is fixed. The lamp cap has electric contacts 13 to which respective current conductors 3 are connected, and metal pins 13 which issue from the base portion 11 to the exterior. In the embodiment drawn, the pins have not only a mechanical function in facilitating mounting in a lampholder, but also an electrical function, i.e. in making electrical contact with terminals of the lampholder, and thus with a supply. Separate electric contacts as in the known lamp are accordingly absent in this embodiment. In the lamp cap 10, a partition wall 20 of insulating material is present which projects into the slit 5 of the lamp vessel and which forms an individual compartment 14 in the lamp cap for each current conductor 3 together with the respective electric contact 13.

The base portion 11 and the shell portion 12 of the lamp cap form one integral body. The partition wall 20 is made of ceramic material and has a foot 21 which is fixed on the base portion 11. It would be technologically difficult to manufacture such a partition wall integrally with the lamp cap.

The foot 21 of the partition wall 20 is fixed to the base portion with cement 22, for example, lamp cement.

The base portion 11 in FIG. 1*a* has corrugations 15 extending transverse to the imaginary connecting line of the metal pins 13, and the foot 21 of the partition wall 20 has complementary corrugations 23 cooperating with the corrugations 15.

Walls 24 (FIG. 1*b*) extend from the foot 21 transverse to the partition wall 20, between which walls the seal 4 of the lamp vessel 1 is accommodated. The walls 24 may be connected to the shell portion 12 by means of cement 22.

The partition wall 20 extends to above the lamp cap 10.

The pins 13 issue from the lamp cap 10 to the exterior through ceramic rings 16 provided outside the lamp cap.

The lamp shown is suitable for being re-ignited in the hot state at a voltage of 50 kV.

We claim:

1. A capped electric lamp comprising:

(a) sealed glass lamp vessel containing an electric element and current conductors connected to said electric element, said current conductors passing through a seal of said lamp vessel and through exteriorly disposed separated individual glass envelopes connected to said seal, said individual glass envelopes being mutually separated by a slit;

(b) a ceramic lamp cap formed of a base portion and a shell portion in which said seal is fixed, said lamp cap including electrical contacts connected to respective said current conductors, and metal pins projecting from said base portion to an exterior of said electric lamp;

(c) a partition wall of insulating material extending into said slit to form individual compartments for said respective current conductors and connected electrical contacts;

wherein the improvement comprises said base portion and said shell portion being a single integral body, and wherein said partition wall includes a foot structure fixed on said base portion, said partition wall being of a ceramic material.

2. A capped electric lamp according to claim 1, wherein said foot structure is fixed to said base portion with cement.

3. A capped electric lamp according to claim 2, wherein said base portion has a first set of corrugations transverse to an imaginary connecting line of said metal pins, and wherein said foot structure of said partition wall has a second set of corrugations complementary with said first set.

4. A capped electric lamp according to claim 3, wherein walls extend from said foot structure transverse to said partition wall, said seal being accommodated between said walls.

5. A capped electric lamp according to claim 4, wherein said walls are connected to said shell portion.

6. A capped electric lamp according to claim 2, wherein walls extend from said foot structure transverse to said partition wall, said seal being accommodated between said walls.

7. A capped electric lamp according to claim 6, wherein said walls are connected to said shell portion.

8. A capped electric lamp according to claim 1, wherein said base portion has a first set of corrugations transverse to an imaginary connecting line of said metal pins, and wherein said foot structure of said partition wall has a second set of corrugations complementary with said first set.

9. A capped electric lamp according to claim 1, wherein said partition wall extends above said lamp cap.

10. A capped electric lamp according to claim 1, wherein said metal pins project to said exterior through ceramic rings outside of said lamp cap.

11. A capped electric lamp according to claim 1, wherein walls extend from said foot structure transverse to said partition wall, said seal being accommodated between said walls.

12. A capped electric lamp according to claim 11, wherein said walls are connected to said shell portion.

* * * * *